US011401147B2

(12) United States Patent
Su

(10) Patent No.: US 11,401,147 B2
(45) Date of Patent: Aug. 2, 2022

(54) PRYING TOOL WITH WIDTH CHANGEABLE PRYING END

(71) Applicant: Hong Ann Tool Industries Co., Ltd., Taichung (TW)

(72) Inventor: Cheng-Wei Su, Taichung (TW)

(73) Assignee: Hong Ann Tool Industries Co., Ltd., Taichung (TW)

( * ) Notice: Subject to any disclaimer, the term of this patent is extended or adjusted under 35 U.S.C. 154(b) by 364 days.

(21) Appl. No.: 16/547,733

(22) Filed: Aug. 22, 2019

(65) Prior Publication Data

US 2020/0140250 A1 May 7, 2020

(30) Foreign Application Priority Data

Nov. 7, 2018 (TW) ..... 107139450

(51) Int. Cl.

| | |
|---|---|
| ***B66F 15/00*** | (2006.01) |
| ***E04G 23/08*** | (2006.01) |
| *B25G 1/06* | (2006.01) |
| *B25B 23/00* | (2006.01) |
| *B25C 11/00* | (2006.01) |

(52) U.S. Cl.

CPC ..... *B66F 15/00* (2013.01); *E04G 23/08* (2013.01); *B25B 23/0028* (2013.01); *B25C 11/00* (2013.01); *B25G 1/06* (2013.01); *E04G 2023/085* (2013.01)

(58) Field of Classification Search

CPC ... E04G 2023/085; E04G 23/08; B25C 11/00; B25G 1/06; B66F 15/00; B25B 23/0028; B25B 27/062

USPC ..... 254/129, 131.5, 131, 25; D8/89; 403/103; 7/166

See application file for complete search history.

(56) References Cited

U.S. PATENT DOCUMENTS

| | | | | |
|---|---|---|---|---|
| 1,375,751 A * | 4/1921 | Grannis | B25B 27/00 | 254/25 |
| 2,052,304 A * | 8/1936 | Kaplan | B25B 27/062 | 29/262 |
| 2,787,491 A * | 4/1957 | Roberts | A01B 1/20 | 294/51 |
| 4,195,398 A * | 4/1980 | Matthews | B25B 27/062 | 29/262 |
| 4,671,493 A * | 6/1987 | Ravencroft | E04G 19/00 | 254/131 |

(Continued)

FOREIGN PATENT DOCUMENTS

| | | |
|---|---|---|
| CN | 102039577 B | 5/2013 |
| CN | 204772394 U | 11/2015 |

(Continued)

*Primary Examiner* — Mahdi H Nejad

(74) *Attorney, Agent, or Firm* — Alan D. Kamrath; Karin L. Williams; Mayer & Williams PC

(57) ABSTRACT

A prying tool includes a prying end with a first prying member and a second prying member pivotally engaged with a main body of the prying tool. The first and the second prying members are pivotal toward and away from each other. The first prying member has a first claw and the second prying member has a second claw respectively. The first and the second prying members are pivotal between a first configuration in which the first and the second claws are adjacent to each other and a second configuration in which the first and the second claws are away from each other.

10 Claims, 8 Drawing Sheets

(56) References Cited

U.S. PATENT DOCUMENTS

| | | | | |
|---|---|---|---|---|
| 6,279,685 | B1 * | 8/2001 | Kogan | B66F 7/20 187/203 |
| 7,322,087 | B1 * | 1/2008 | Hu | B25B 27/023 29/255 |
| 8,201,806 | B2 | 6/2012 | Liou | |
| 8,215,617 | B2 | 7/2012 | Liou | |
| 8,297,596 | B2 | 10/2012 | Su | |
| 10,166,663 | B1 * | 1/2019 | Christensen | B25B 13/06 |
| D887,810 | S * | 6/2020 | Su | D8/89 |
| 2010/0140575 | A1 * | 6/2010 | Liou | B66F 15/00 254/131.5 |
| 2010/0207081 | A1 * | 8/2010 | Liou | B25F 1/006 254/129 |
| 2012/0145978 | A1 * | 6/2012 | Rich | B62B 3/0606 254/2 R |
| 2013/0233651 | A1 * | 9/2013 | Kritzer | B66F 3/46 187/208 |
| 2016/0023873 | A1 * | 1/2016 | Kasan | E04G 23/08 254/131.5 |
| 2020/0002145 | A1 * | 1/2020 | Liou | B66F 15/00 |

FOREIGN PATENT DOCUMENTS

| | | | |
|---|---|---|---|
| CN | 205614582 | U | 10/2016 |
| DE | 202008007740 | U1 | 8/2008 |
| TW | 201020074 | A | 6/2010 |
| TW | I336284 | B | 1/2011 |
| TW | I340685 | B | 4/2011 |
| TW | I371351 | B | 9/2012 |

* cited by examiner

PRYING TOOL WITH WIDTH CHANGEABLE PRYING END

BACKGROUND OF THE INVENTION

1. Field of the Invention

The present invention relates to a prying tool and, particularly, to a prying tool with a width changeable prying end.

2. Description of the Related Art

TW Pat. No. 1340685 shows a prying tool including a handle, two prying members, and two positioning devices. The handle includes a head portion and a grip portion. The first ends of the prying members are sleeved on the head portion and are movable on the head portion. The second ends of the prying members are configured to engage with an object to be pried. The positioning devices are configured to keep the prying members at various fixed positions with respect to the head portion and are disposed between the head portion and the prying members. The positioning devices are movable between a lock position and a release position. When the positioning devices are in the lock position, the prying members are restrained from moving relative to the handle portion. When the positioning devices are in the release position, the prying members are adapted to be moved relative to the head portion. When the prying members are adjacent to each other and cannot be moved closer, there is a gap opening delimited by the prying members when the prying members are adjacent to each other. The gap opening increases in width as the prying members move apart from each other. Therefore, a user can move the prying members closer for prying small objects and move them apart for prying large objects.

Since the prying tool has a wide head portion, it is impossible to use the prying tool in a restricted working space.

The present invention is, therefore, intended to obviate or at least alleviate the problems encountered in the prior art.

SUMMARY OF THE INVENTION

The present invention discloses a prying tool with a width changeable prying end. The prying end includes a first prying member and a second prying member pivotally engaged with a main body of the prying tool. The first and the second prying members are pivotal toward and away from each other. The first prying member has a first claw and the second prying member has a second claw respectively. The first and the second prying members are pivotal between a first configuration in which the first and the second claws are adjacent to each other and a second configuration in which the first and the second claws are away from each other.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and especially the scientists, engineers and practitioners in the art who are not familiar with patent or legal terms or phraseology, to determine quickly from a cursory inspection the nature and essence of the technical disclosure. The abstract is neither intended to define the invention, which is measured by the claims, nor is it intended to be limiting as to the scope of the invention in any way.

Other objectives, advantages, and new features of the present invention will become apparent from the following detailed description of the invention when considered in conjunction with the accompanied drawings.

DETAILED DESCRIPTION OF THE INVENTION

Figure 1:
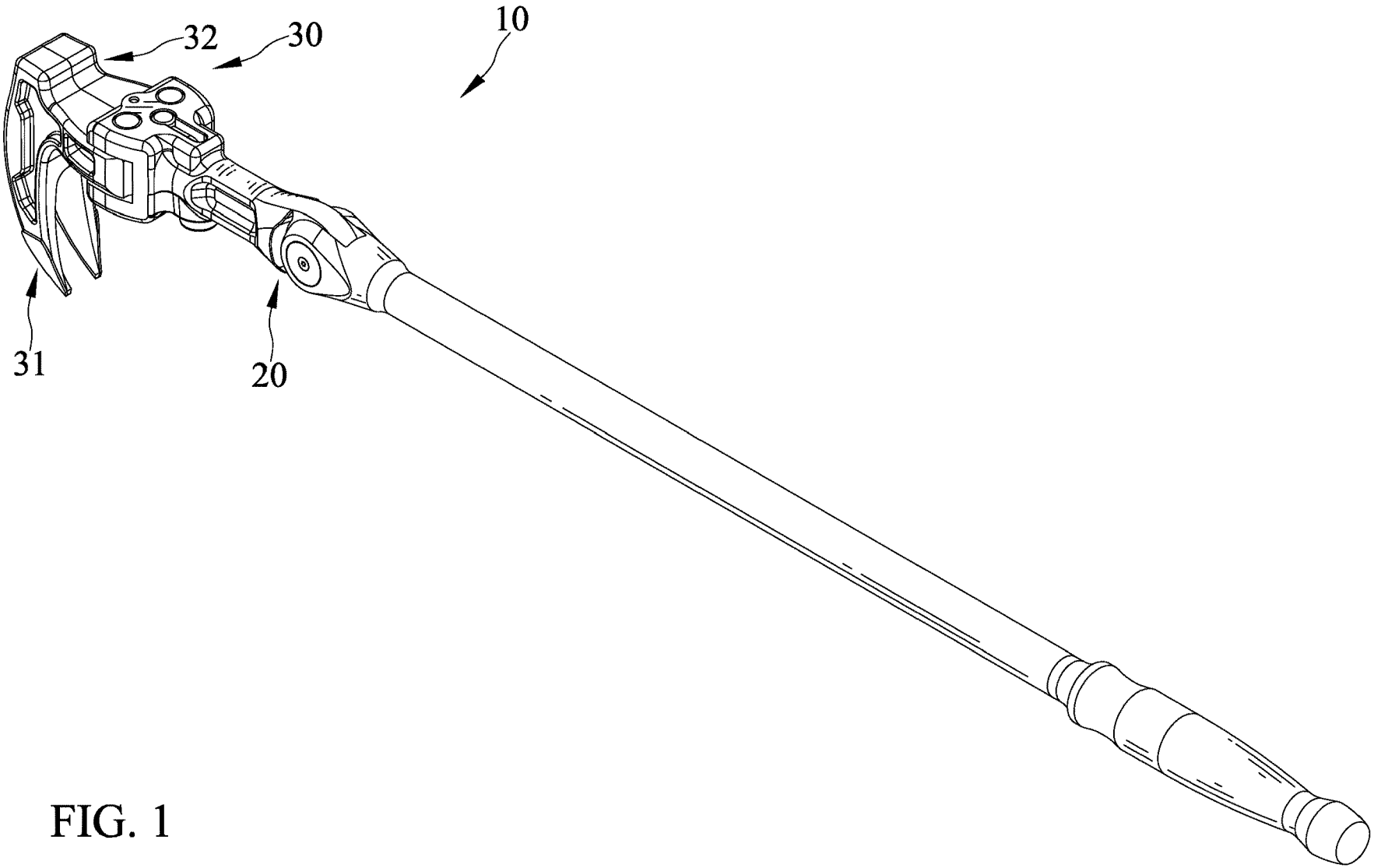
FIG. 1 is a perspective view showing a prying tool in accordance with the present invention and showing a prying end of the prying tool in a first configuration.
Figure 2:
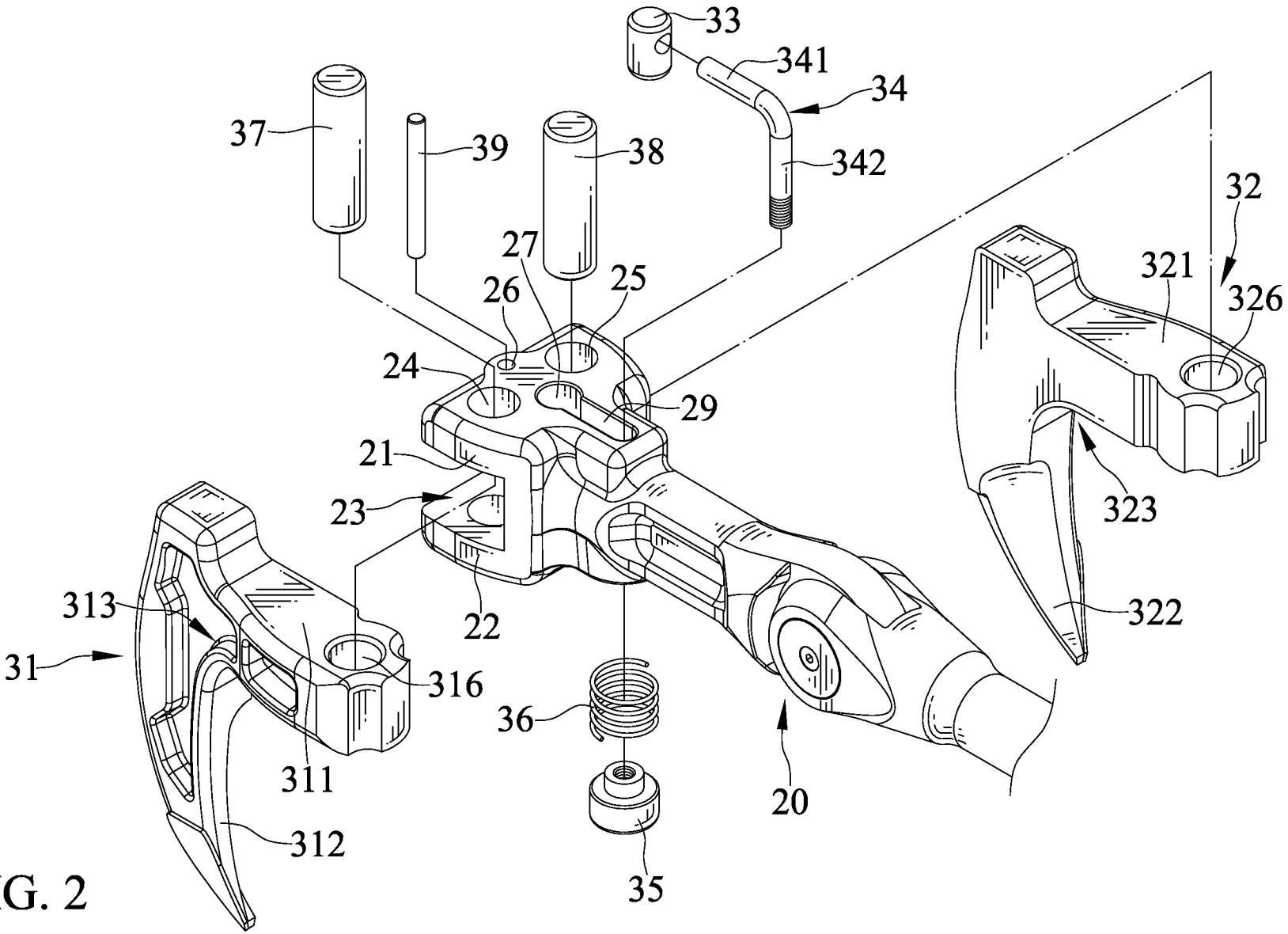
FIG. 2 is an exploded perspective view of the prying tool of FIG. 1.
Figure 3:
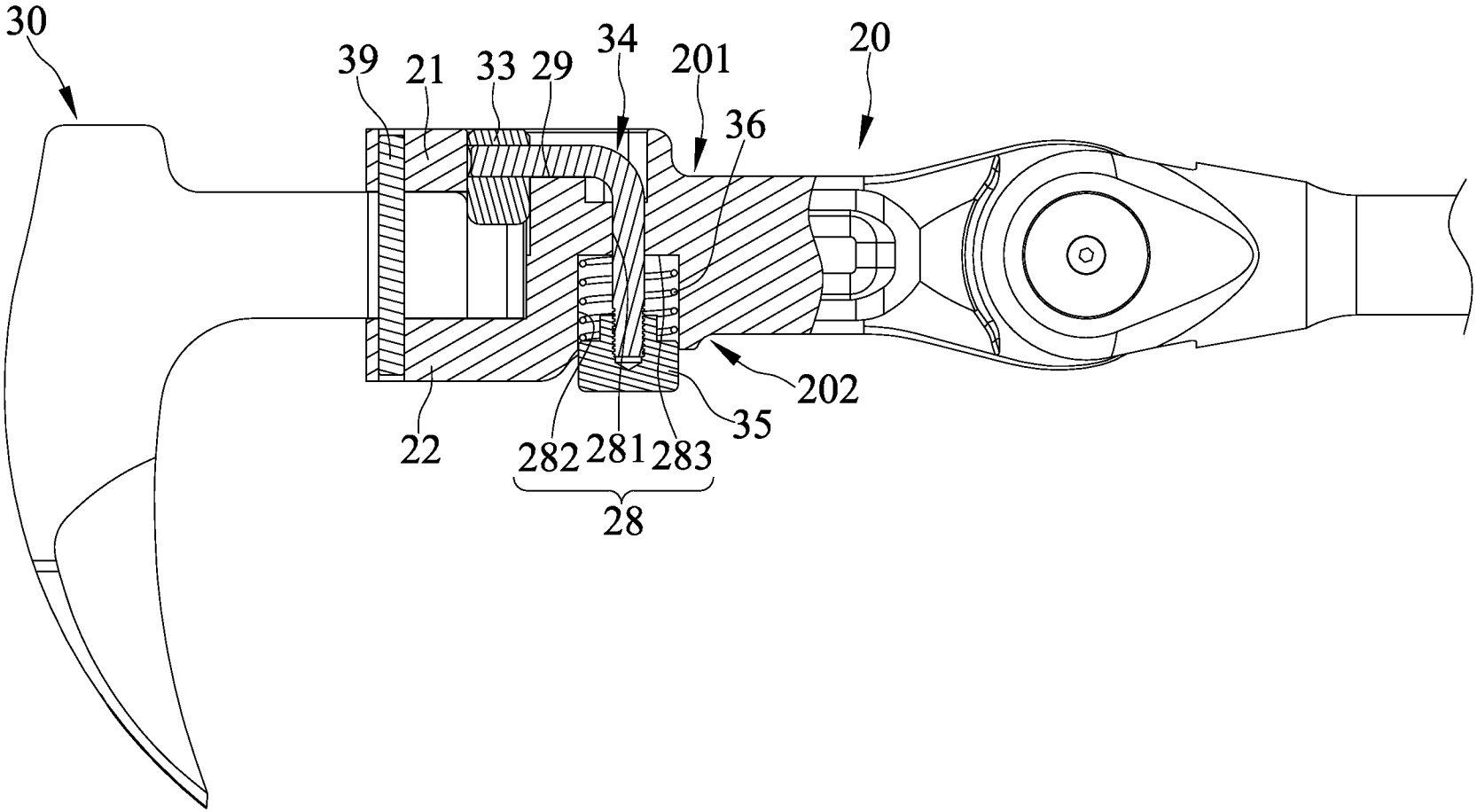
FIG. 3 is a partial, cross-sectional view of the prying tool of FIG. 1.
Figure 4:
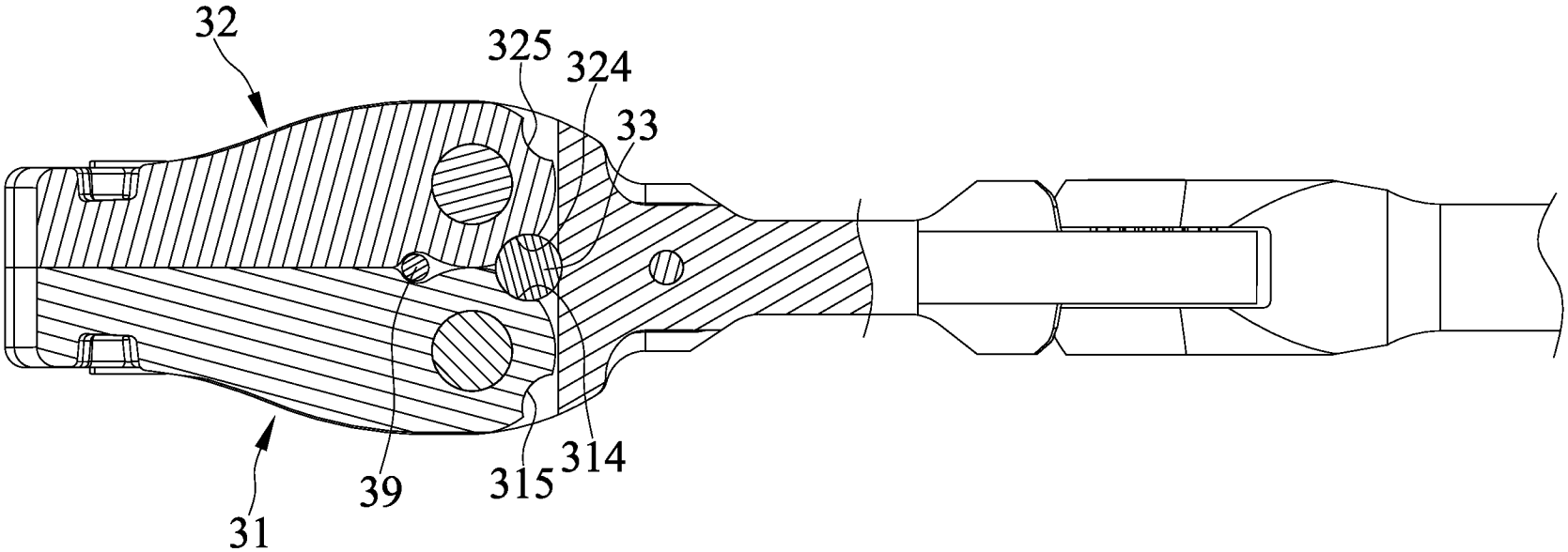
FIG. 4 is another partial, cross-sectional view of the prying tool of FIG. 1.
Figure 5:
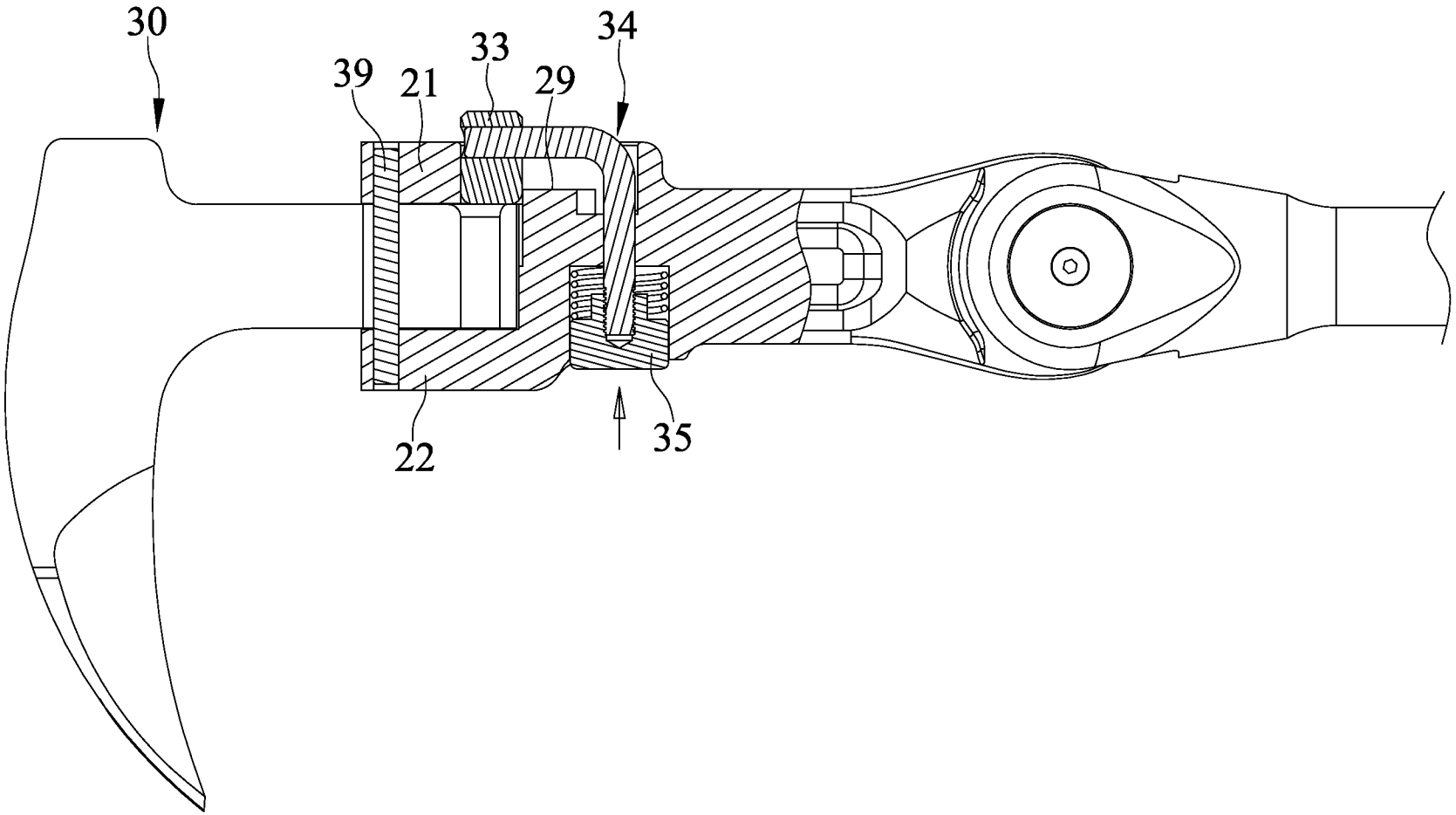
FIG. 5 is a cross-sectional view illustrating the operation of a position restrainer of the prying tool of FIG. 1 from a lock position shown in FIG. 3 to a release position.
Figure 6:
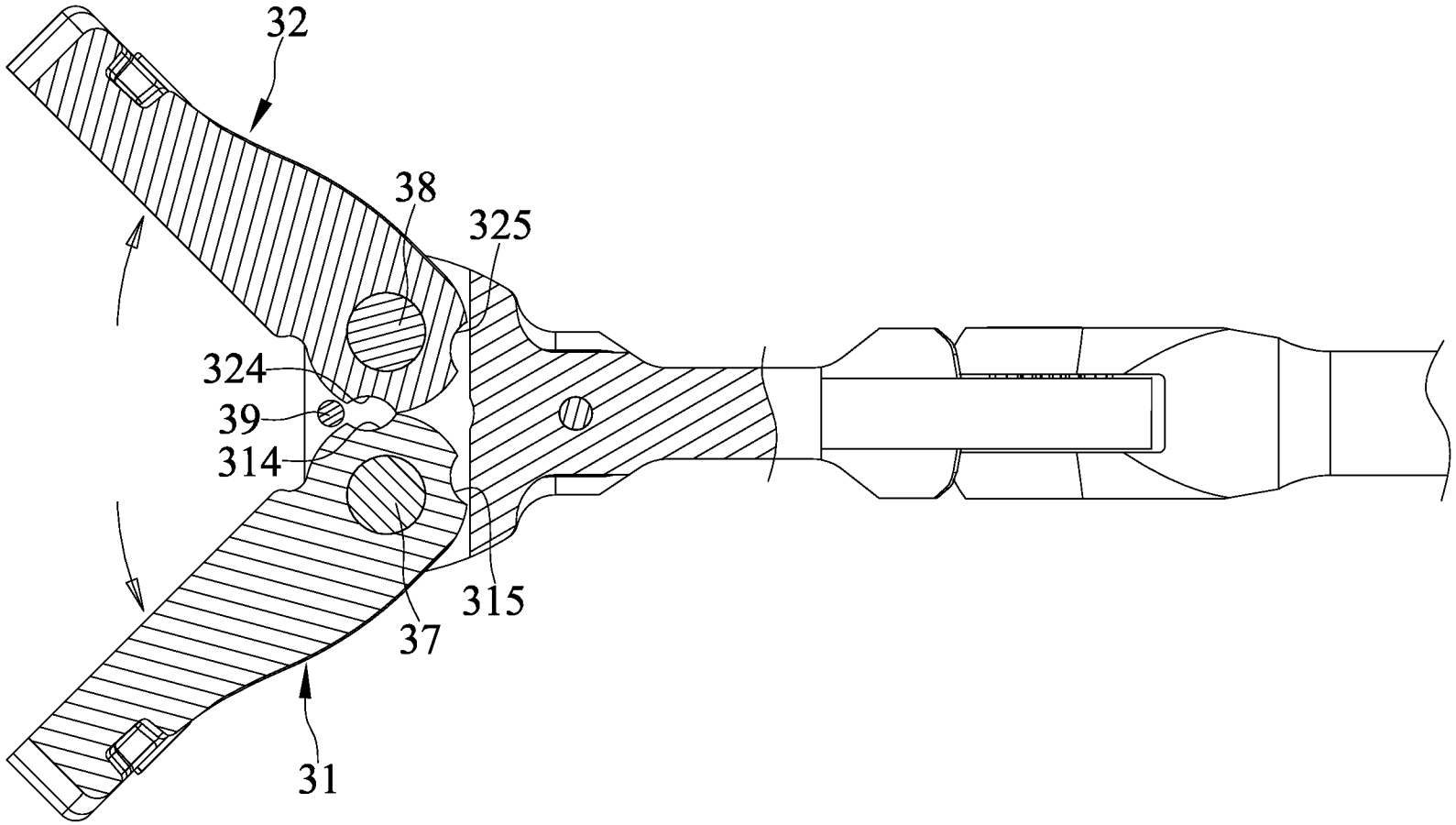
FIG. 6 is a cross-sectional view showing the prying end of the prying tool of FIG. 1 in a second configuration.
Figure 7:
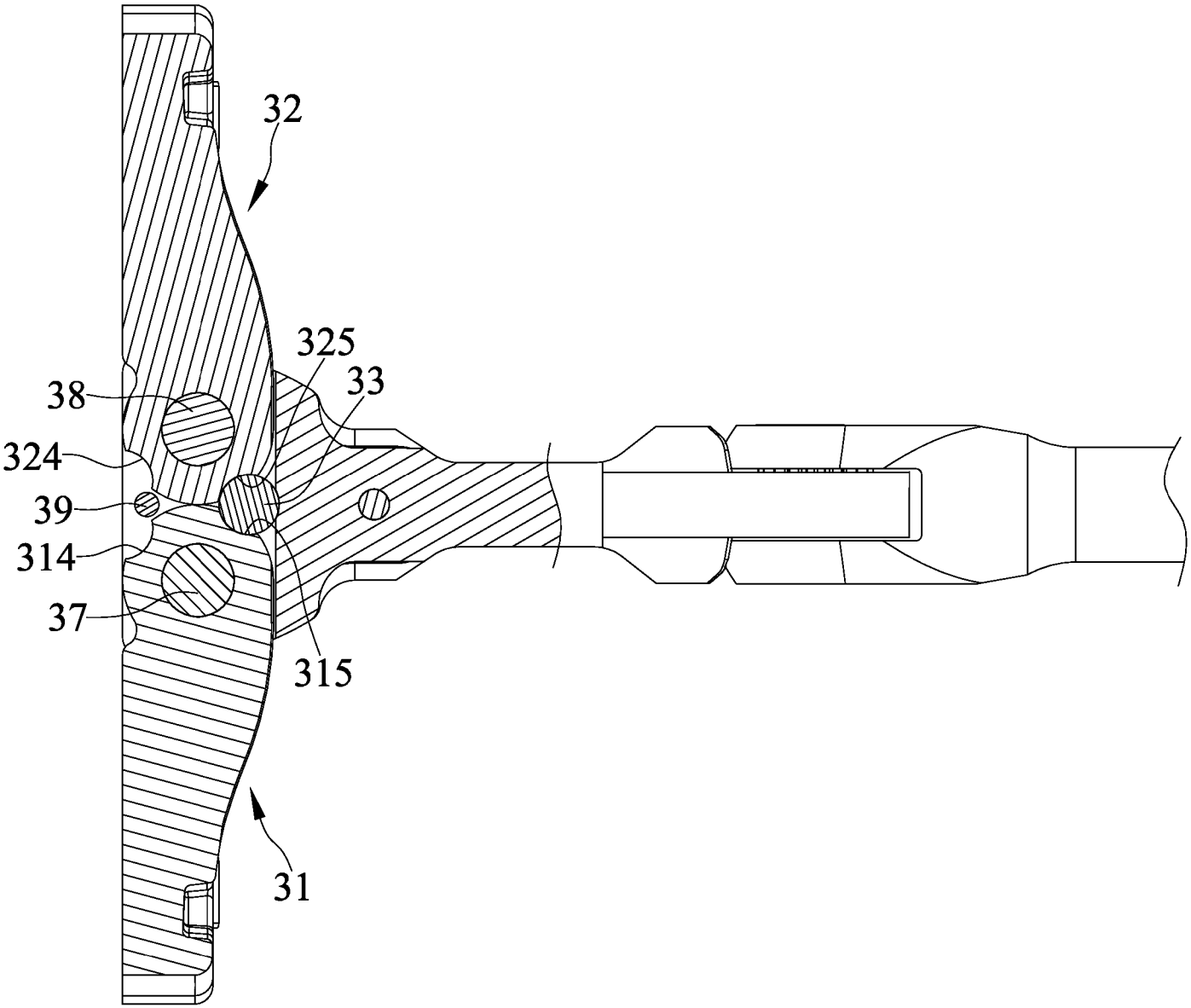
FIG. 7 is a cross-sectional view showing the prying end of the prying tool of FIG. 1 in a third configuration.
Figure 8:
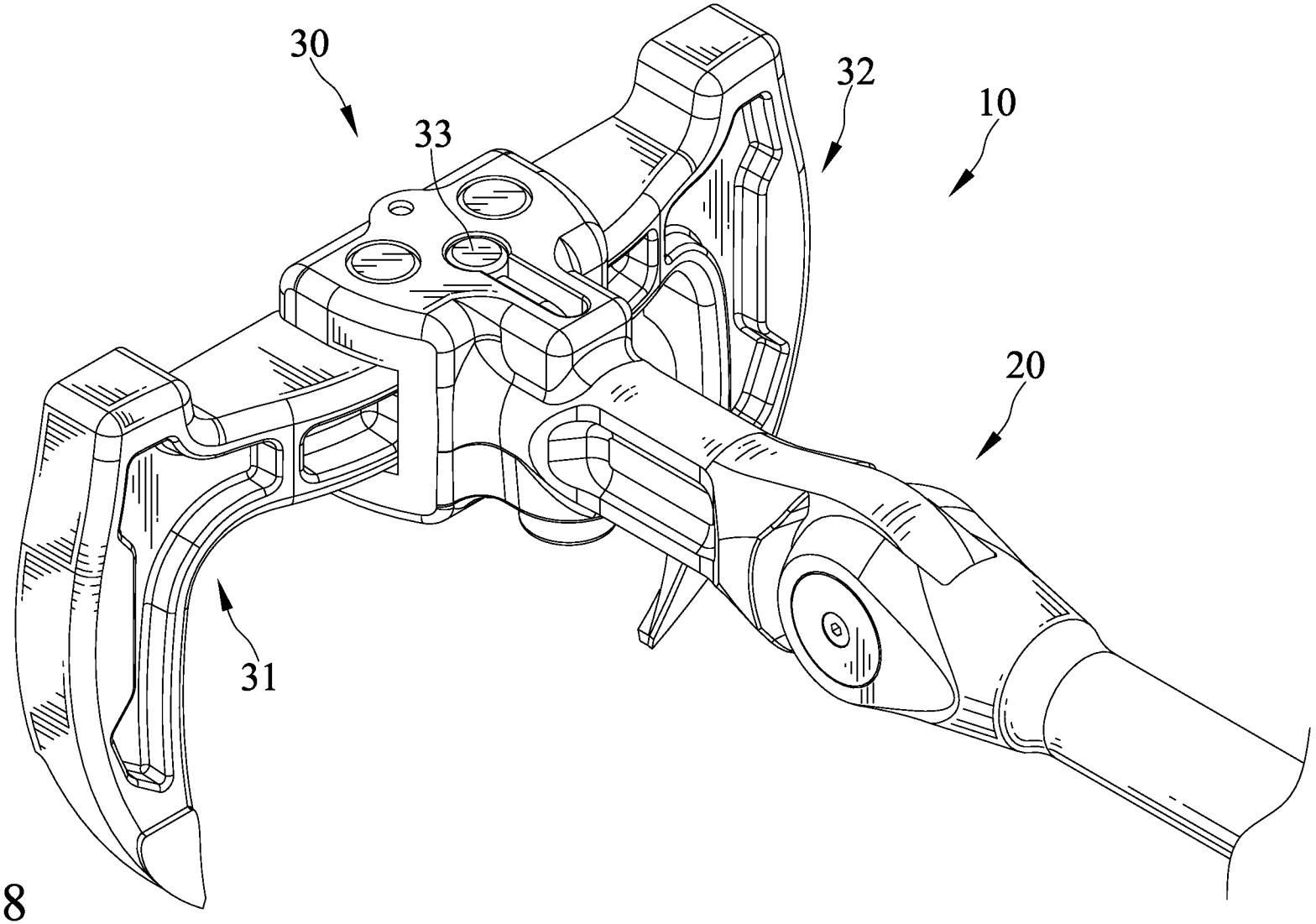
FIG. 8 is a perspective view showing the prying end of the prying tool of FIG. 1 in the third configuration.

FIGS. 1 through 8 show a prying tool 10 with a width changeable prying end according to the present invention.

The prying tool 10 has a prying end 30. The prying end 30 includes a prying member 31 and a prying member 32 pivotally engaged with a main body 20 of the prying tool 10. The prying members 31 and 32 are pivotal toward and away from each other.

The prying members 31 and 32 respectively include an arm 311 and an arm 321 pivotally engaged with the main body 20. The main body 20 has a joining side 21 and a joining side 22 disposed separately and defines a slot 23 between the joining side 21 and the joining side 22. The main body 20 has a side 201 contiguous to the joining side 21 and a side 202 contiguous to the joining side 22. The arms 311 and 321 of the prying members 31 and 32 are pivotally engaged with the joining side 21 and the joining side 22 and inserted into the slot 23. The joining side 21 and the arm 311 respectively define pivot holes 24 and 316. The pivot holes 24 and 316 include a pivot 37 engaged therein, whereby the prying member 31 is pivotal about the pivot 37. The joining side 21 and the arm 321 respectively define pivot holes 25 and 326. The pivot holes 25 and 326 include a pivot 38 engaged therein, whereby the prying member 32 is pivotal about the pivot 38.

The prying member 31 has a claw 312 and the prying member 32 has a claw 322 respectively. The claw 312 extends from the arm 311 and the claw 322 extends from the arm 321 respectively. The claw 312 extends radially from the arm 311 and the prying member 31 has a curved portion 313 extending from the arm 311 to the claw 312. The claw 322 extends radially from the arm 321 and the prying member 32 has a curved portion 323 extending from the arm 321 to the claw 322.

The prying members 31 and 32 are pivotal between a first configuration in which the claws 312 and 322 are adjacent to each other and a second configuration in which the claws 312 and 322 are away from each other. The arm 311 and the arm 321 are adjacent to each other when the claws 312 and 322 are adjacent to each other. The first arm 311 abuts against the second arm 321 when the first arm 311 and the second arm 321 are adjacent to each other. The prying end 30 increases its width when the prying members 31 and 32 pivot from the first configuration to the second configuration. The first claw 312 abuts against the second claw 322 when the first and the second claws 312 and 322 are adjacent to each other. Conversely, the prying end 30 decreases its width when the prying members 31 and 32 pivot from the second configuration to the first configuration.

The prying tool 10 includes a position restrainer 33 movably disposed on the main body 20 and adapted to engage and disengage from the prying members 31 and 32 for selectively preventing pivotal movement of the prying members 31 and 32 with respect to the main body 20. The position restrainer 33 is movable between a restraining position and a release position. The prying members 31 and 32 are prevented from pivoting with respect to the main body 20 when the position restrainer 33 is in the restraining position. The prying members 31 and 32 are allowed to pivot when the position restrainer 33 is in the release position.

Each of the prying members 31 and 32 has a plurality of engaging portions 314, 315, 324, and 325 with which the position restrainer 33 is adapted to engage. The plurality of engaging portions 314 and 315 of the prying member 31 are disposed circumferentially on the arm 311. The plurality of engaging portions 324 and 325 of the prying member 32 are disposed circumferentially on the arm 321. Each of the plurality of engaging portions 314 of the prying member 31 and the plurality of engaging portions 324 of the prying member 32 is in a form of a recess.

The position restrainer 33 is engaged with one of the plurality of engaging portions 314 and 315 of the prying member 31 and one of the plurality of engaging portions 324 of the second prying member 32 when the prying members 31 and 32 are prevented from pivoting with respect to the main body 20. The position restrainer 33 is engaged with a first of the plurality of engaging portions 314 of the prying member 31 and a first of the plurality of engaging portions 324 of the prying member 32 when the prying members 31 and 32 are in the first configuration. The position restrainer 33 is engaged with a second of the plurality of engaging portions 314 of the prying member 31 and a second of the plurality of engaging portions 324 of the prying member 32 when the arms 311 and 321 are disposed axially.

The position restrainer 33 is adapted to move in and out of a hole 27 of the main body 20. The position restrainer 33 is moved in the hole 27 when in the restraining position and is moved out the hole 27 when in the release position. The hole 27 is connected to the slot 23.

The position restrainer 33 is adapted to be operably moved by a controller 35. The position restrainer 33 and the controller 35 are connected together by a link 34. The link 34 is L-shaped. The link 34 includes a first end 341 connected to position restrainer 33 and a second end 342 connected to the controller 35. The link 34 extends into a hole 29 and a cavity 28 of the main body 20 when the position restrainer 33 is in the restraining position. The hole 29 extends between the hole 27 and the cavity 28. The hole 29 is connected to the hole 27. The cavity 28 is connected to the hole 29. The cavity 28 has a section 281 and a section 282 with the section 281 having a smaller diametrical size than the section 282. The controller 35 is urged by a resilient member 36. The controller 35 and the resilient member 36 are disposed in the section 282 of the cavity 28. The resilient member 36 has an end against a wall 283 extending from the section 281 of the cavity 28 to the section 282 of the cavity 28 and an end against the controller 35.

Further, a position limiter 39 is disposed between the prying members 31 and 32. The position limiter 39 has an end connected to the joining side 21 and an end connected to the joining side 22 and is inserted in an orifice 26 of the main body 20. The orifice 26 extends into the joining sides 21 and 22.

In view of the foregoing, the prying members 31 and 32 are pivotal toward and away from each other. The prying end 30 increases its width when the prying members 31 and 32 pivot from the first configuration to the second configuration. The first claw 312 abuts against the second claw 322 when the first and the second claws 312 and 322 are adjacent to each other. Conversely, the prying end 30 decreases its width when the prying members 31 and 32 pivot from the second configuration to the first configuration.

The foregoing is merely illustrative of the principles of this invention, and various modifications can be made by those skilled in the art without departing from the scope and spirit of the invention.

What is claimed is:

1. A prying tool comprising:

a prying end including a first prying member and a second prying member pivotally engaged with a main body of the prying tool, wherein the first and the second prying members are pivotal toward and away from each other, wherein the first prying member has a first claw and the second prying member has a second claw respectively, wherein the first and the second prying members are pivotal between a first configuration in which the first and the second claws are adjacent to each other and a second configuration in which the first and the second claws are away from each other, wherein the first and second prying members respectively include a first arm and a second arm pivotally engaged with the main body, wherein the first claw extends from the first arm and the second claw extends from the second arm respectively, wherein the first arm and the second arm are adjacent to each other when the first and the second claws are adjacent to each other, and wherein the prying tool further comprises a position restrainer movably disposed on the main body and adapted to engage and disengage from the first and the second prying members for selectively preventing pivotal movement of the first and the second prying members with respect to the main body, wherein the position restrainer is movable between a restraining position and a release position, wherein the first and the second prying members are prevented from pivoting with respect to the main body when the position restrainer is in the restraining position, wherein the first and the second prying members are allowed to pivot when the position restrainer is in the release position, wherein the position restrainer is adapted to move in and out of a first hole of the main body, and wherein the position restrainer is moved in the first hole when in the restraining position and is moved out the first hole when in the release position, wherein the position restrainer is adapted to be operably moved by a controller, wherein the position restrainer and the controller are connected together by a link.

2. The prying tool as claimed in claim 1, wherein the link is L-shaped.

3. The prying tool as claimed in claim 2, wherein the controller is urged by a resilient member, wherein the link extends into a second hole and a cavity of the main body when the position restrainer is in the restraining position, wherein the second hole extends between the first hole and the cavity, wherein the cavity has a first section and a second section with the first section having a smaller diametrical size than the second section, wherein the controller and the resilient member are disposed in the second section of the cavity, and wherein the resilient member has a first end against a wall extending from the first section of the cavity to the second section of the cavity and a second end against the controller.

4. The prying tool as claimed in claim 1, wherein each of the first and second prying members has a plurality of engaging portions with which the position restrainer is adapted to engage, wherein the position restrainer is engaged with one of the plurality of engaging portions of the first prying member and one of the plurality of engaging portions of the second prying member when the first and second prying members are prevented from pivoting with respect to the main body.

5. The prying tool as claimed in claim 4, wherein each of the plurality of engaging portions of the first prying member and each of the plurality of engaging portions of the second prying member is in a form of a recess.

6. The prying tool as claimed in claim 4, wherein the position restrainer is engaged with a first of the plurality of engaging portions of the first prying member and a first of the plurality of engaging portions of the second prying member when the first and second prying members are in the first configuration.

7. The prying tool as claimed in claim 6, wherein the position restrainer is engaged with a second of the plurality of engaging portions of the first prying member and a second of the plurality of engaging portions of the second prying member when the first and second arms are disposed axially.

8. The prying tool as claimed in claim 4, wherein the main body has a first joining side and a second joining side disposed separately and defines a slot between the first joining side and the second joining side, and wherein the first and the second arms of the first and the second prying members are pivotally engaged with the first joining side and the second joining side and inserted into the slot.

9. The prying tool as claimed in claim 8 further comprising a position limiter disposed between the first and the second prying members, wherein the position limiter has a first end connected to the first joining side and a second end connected to the second joining side and is inserted in an orifice of the main body, and wherein the orifice extends into the first and the second joining sides.

10. The prying tool as claimed in claim 8, wherein the first claw extends radially from the first arm and the first prying member has a first curved portion extending from the first arm to the first claw, and wherein the second claw extends radially from the first arm and the second prying member has a second curved portion extending from the second arm to the second claw.

* * * * *